US012391894B2

(12) United States Patent
Sekimoto et al.

(10) Patent No.: US 12,391,894 B2
(45) Date of Patent: Aug. 19, 2025

(54) OXIDATION DEVICE, OXIDATION METHOD, AND METHOD FOR PRODUCING MODIFIED FUEL

(71) Applicant: NIPPON STEEL ENGINEERING CO., LTD., Tokyo (JP)

(72) Inventors: Kenichi Sekimoto, Tokyo (JP); Eiichiroh Mori, Tokyo (JP)

(73) Assignee: NIPPON STEEL ENGINEERING CO., LTD, Tokyo (JP)

( * ) Notice: Subject to any disclaimer, the term of this patent is extended or adjusted under 35 U.S.C. 154(b) by 20 days.

(21) Appl. No.: 18/563,068

(22) PCT Filed: Mar. 15, 2022

(86) PCT No.: PCT/JP2022/011733
§ 371 (c)(1),
(2) Date: Nov. 21, 2023

(87) PCT Pub. No.: WO2022/270046
PCT Pub. Date: Dec. 29, 2022

(65) Prior Publication Data

US 2024/0228900 A1 Jul. 11, 2024

(30) Foreign Application Priority Data

Jun. 24, 2021 (JP) ..... 2021-104606

(51) Int. Cl.
*C10L 9/06* (2006.01)

(52) U.S. Cl.
CPC ..... *C10L 9/06* (2013.01); *C10L 2290/10* (2013.01); *C10L 2290/56* (2013.01); *C10L 2290/60* (2013.01)

(58) Field of Classification Search
CPC ..... C10L 9/06; C10L 2290/56
See application file for complete search history.

(56) References Cited

U.S. PATENT DOCUMENTS 5,711,769 A 1/1998 Rinker et al.
2012/0023813 A1* 2/2012 Sethi ..... C10B 53/02 44/605

(Continued)

FOREIGN PATENT DOCUMENTS

AU 2015302811 A1 3/2017
AU 2019268089 A1 12/2019

(Continued)

OTHER PUBLICATIONS

ISR issued in PCT/JP2022/011733, mailed Apr. 19, 2022.

*Primary Examiner* — Ellen M McAvoy
*Assistant Examiner* — Ming Cheung Po
(74) *Attorney, Agent, or Firm* — Greer Burns & Crain Ltd.

(57) ABSTRACT

Provided is an oxidation equipment for oxidizing a raw material containing at least one of carbonized coal and a torrefied biomass, the oxidation equipment including: a main body unit forming a fluidized bed; a gas supply unit supplying an oxygen-containing gas so that the raw material flows; a gas discharge unit discharging gas which has passed through the fluidized bed; a cooling unit cooling an oxidized product obtained by oxidizing the raw material; and a delivery unit delivering the oxidized product from the cooling unit, in which the main body unit has a first pressure measurement unit in a freeboard portion and a second pressure measurement unit in a portion through which the fluidized bed passes, and the delivery unit has a delivery amount control unit that controls the delivery amount of the oxidized product based on a differential pressure of the first and second pressure measurement units.

11 Claims, 12 Drawing Sheets

(56) References Cited

U.S. PATENT DOCUMENTS

| | | | | |
|---|---|---|---|---|
| 2012/0173170 | A1* | 7/2012 | Bhusarapu | F27B 15/18 702/50 |
| 2014/0345193 | A1 | 11/2014 | Nakagawa et al. | |
| 2015/0376531 | A1 | 12/2015 | Atarashiya et al. | |
| 2016/0355744 | A1 | 12/2016 | Nakagawa et al. | |
| 2018/0345308 | A1* | 12/2018 | Chandran | B08B 9/00 |

FOREIGN PATENT DOCUMENTS

| | | | | |
|---|---|---|---|---|
| AU | 2018378746 | A1 | 6/2020 | |
| JP | 62050393 | A | 3/1987 | |
| JP | 09071791 | A | 3/1997 | |
| JP | 09104871 | A | 4/1997 | |
| JP | 2013139537 | A | 7/2013 | |
| JP | 2014169375 | A | 9/2014 | |
| JP | 2015030736 | A | 2/2015 | |
| JP | 2015150520 | A | 8/2015 | |
| JP | 2016040364 | A | 3/2016 | |
| JP | 2019099777 | A | 6/2019 | |
| WO | WO-2007141833 | A1 * | 12/2007 | C10L 3/06 |
| WO | WO-2009109644 | A1 * | 9/2009 | B01J 8/26 |
| WO | 2010069068 | A1 | 6/2010 | |
| WO | 2019220720 | A1 | 11/2019 | |

* cited by examiner

OXIDATION DEVICE, OXIDATION METHOD, AND METHOD FOR PRODUCING MODIFIED FUEL

This application is a 35 U.S.C. § 371 national phase application of PCT/JP2022/011733, filed on Mar. 15, 2022, which claims priority to Japanese Patent Application No. 2021-104606, filed on Jun. 24, 2021.

TECHNICAL FIELD

The present disclosure relates to an oxidation equipment, an oxidation method, and a method for producing a modified fuel.

BACKGROUND ART

When low-grade coal such as lignite and sub-bituminous coal is carbonized, the surface is activated and reacts with oxygen in air to generate heat spontaneously. To reduce such spontaneous heat generation, a technique of inactivating carbonized coal using a process gas containing oxygen is known. For example, Patent Literature 1 proposes a technique of inactivating carbonized coal, obtained through carbonization and drying of coal, using a process gas within a temperature range of 40° C. to 95° C. As the process gas, a gas obtained by mixing nitrogen with air and adjusting the oxygen concentration to about 5% or 10% has been used.

Equipments with packed beds and equipments with rotary kilns are known as equipments that inactivate coal. For example, Patent Literature 2 and 3 propose an equipment with a rotary kiln as a treatment equipment for inactivating carbonized coal with a process gas containing oxygen. Patent Literature 2 and 3 describe that inactivated coal can be produced in a short period of time using a treatment equipment with a rotary kiln.

CITATION LIST

Patent Literature

[0004] [Patent Literature 1] Japanese Unexamined Patent Publication No. 2013-139537

[Patent Literature 2] Japanese Unexamined Patent Publication No. 2014-169375

[Patent Literature 3] Japanese Unexamined Patent Publication No. 2015-150520

SUMMARY OF INVENTION

Technical Problem

Inactivation of a solid such as coal is a gas-solid reaction and performed by an oxidation reaction between oxygen atoms and functional groups in the solid. However, as in Patent Literature 1, even if the inactivation treatment is performed within a temperature range of 40° C. to 95° C., the oxidation of the functional groups does not proceed sufficiently, and therefore, it is difficult to sufficiently reduce the spontaneous heat generation. On the other hand, when the inactivation is performed in a rotary kiln as in Patent Literature 2 and 3, although solids are periodically stirred by rotation of the kiln, it is difficult to supply oxygen to the vicinity of the solids while the solids are staying at the bottom. For this reason, as the oxidation reaction of the solids proceeds, the oxygen concentration around the solid decreases. Thus, the diffusion rate of oxygen into the solid decreases, and the gas-solid reaction in the solid is slowed down.

In addition, due to the structure of the rotary kiln, it is difficult to finely adjust the operation according to the temperature of a material to be treated, and the response to the operation adjustment tends to be slow. Furthermore, in the case of the rotary kiln, it is necessary to install a plurality of gas blowing pipes, cooling pipes, supports, and the like along the longitudinal direction, which tends to increase equipment costs.

The present disclosure provides an oxidation equipment and an oxidation method capable of smoothly performing oxidation on a raw material having spontaneous heat generation in a short period of time and sufficiently reducing variations in oxidation. In addition, the present disclosure provides a method for producing an oxidized product in which modified fuel with sufficiently reduced spontaneous heat generation can be smoothly produced in a short period of time.

Solution to Problem

According to one aspect of the present disclosure, there is provided an oxidation equipment for oxidizing a raw material containing at least one of carbonized coal and a torrefied biomass, the equipment including: a main body unit configured to form a fluidized bed for oxidizing the raw material while making it flow; a gas supply unit configured to supply an oxygen-containing gas at 150° C. to 300° C. from a lower portion of the main body unit so that the raw material flows; a gas discharge unit configured to discharge gas which has passed through the fluidized bed from the main body unit; a cooling unit configured to cool an oxidized product obtained by oxidizing the raw material downstream of the main body unit; and a delivery unit configured to deliver the oxidized product from the cooling unit, in which the main body unit has a first pressure measurement unit in a freeboard portion and a second pressure measurement unit in a portion through which the fluidized bed passes, and the delivery unit has a delivery amount control unit that controls a delivery amount of the oxidized product based on differential pressure between a pressure measured by the first pressure measurement unit and a pressure measured by the second pressure measurement unit.

The above-described oxidation equipment supplies the oxygen-containing gas at 150° C. to 300° C. from the lower portion of the main body unit, forms a fluidized bed in the main body unit, and oxidizes the raw material while making it flow. Since the oxygen-containing gas at 150° C. to 300° C. is used, functional groups contained in the raw material can be sufficiently oxidized. In addition, since the fluidized bed is formed, the oxygen-containing gas is sufficiently supplied from the gas supply unit to the vicinity of the raw material. Since a gas after an oxidation reaction is quickly replaced with the oxygen-containing gas and discharged from the gas discharge unit, the oxygen concentration in the gas around the raw material can be maintained at a sufficiently high level. Accordingly, the diffusion rate of oxygen to the surface and inside of the raw material is maintained, and the gas-solid reaction rate can be sufficiently increased. In addition, the delivery unit has a delivery amount control unit that controls the delivery amount of the oxidized product based on a differential pressure between a pressure measured by the first pressure measurement unit and a pressure measured by the second pressure measurement unit. Thus, the retention time can be flexibly adjusted according to the properties of raw materials and the properties of oxidized products. Accordingly, the variations in oxidation can be reduced even if raw materials are of different types, such as carbonized coal and torrefied biomass, or raw materials are made into briquettes. Due to these factors, it is possible to more smoothly oxidize a raw material in a short period of time and more sufficiently reduce the variations in oxidation compared to in a rotary kiln.

In addition, since the diffusion rate of oxygen to the surface and inside of the raw material can be maintained, even if the raw material has a wide particle size distribution, it is possible to sufficiently reduce the variations in oxidation. In addition, since it is sufficient as long as the above-described oxidation equipment can form a fluidized bed, it is also possible to simplify the facility compared to a facility using a rotary kiln. In addition, since the oxidation equipment has a cooling unit and a delivery unit, the oxidation reaction can be quickly stopped, and the oxidized product can be delivered with high safety. In addition, the spontaneous heat generation of the oxidized product can be further reduced.

The above-described oxidation equipment includes the delivery amount control unit that controls the delivery amount of the oxidized product obtained by oxidizing the raw material downstream of the main body unit. Thus, the retention time of the oxidized product and the raw material oxidized in the main body unit can be flexibly adjusted. Accordingly, it is possible to further reduce the variations in oxidation of the oxidized product.

The raw material may contain torrefied biomass. The cooling unit may cool the oxidized product to 60° C. or lower with an inert gas. Thus, the oxidation reaction can be quickly stopped, and the oxidized product can be delivered with high safety. In addition, the spontaneous heat generation of the oxidized product can be further reduced.

The above-described oxidation equipment may include a partition plate that divide an upper portion of an internal space of the main body unit into a plurality of parts, and a plurality of zones divided by the partition plate may be arranged adjacent to each other along the flow direction of the raw material. Thus, the operation conditions (for example, the temperature and the oxygen concentration) can be individually adjusted for each zone according to the progress degree of the oxidation reaction. Accordingly, it is possible to adjust the operation conditions with higher accuracy, and it is possible to further reduce the variations in oxidation of the oxidized product.

The above-described oxidation equipment may have a configuration in which a temperature of each of the plurality of zones is individually controllable. Thus, the temperature can be controlled for each zone according to the progress degree of the oxidation reaction. Accordingly, it is possible to further reduce the variations in oxidation of the oxidized product.

The above-described oxidation equipment may include an oxygen concentration control unit that controls an oxygen concentration of the oxygen-containing gas to be 13 volume % or less. Thus, it is possible to sufficiently suppress rapid progress of the oxidation reaction. In addition, it is possible to adjust the temperature in the main body unit with high accuracy, and it is possible to further reduce the variations in oxidation of the oxidized product.

The above-described oxidation equipment may include: a circulation flow path configured to circulate the gas discharged from the gas discharge unit to the gas supply unit; an oxygen concentration measurement unit configured to measure an oxygen concentration of a circulation gas circulating in the circulation flow path; and an oxygen concentration control unit configured to control, based on measurement results of the oxygen concentration measurement unit, an oxygen concentration of the oxygen-containing gas, supplied from the gas supply unit. Thus, it is possible to promote effective use of gases and reduce operating costs.

The above-described oxidation equipment may include a collection unit configured to collect a solid content contained in the gas discharged from the gas discharge unit. The solid content collected in the collection unit may be used as an oxidized product or may be reused as a raw material depending on the state of oxidation. In this manner, the raw material can be effectively utilized, and operating costs can be reduced.

The above-described oxidation equipment may include: a support member configured to be placed between the gas supply unit and the fluidized bed to support the fluidized bed and allow the oxygen-containing gas to pass therethrough; and a vibration mechanism configured to vibrate the support member. Thus, the raw material constituting the fluidized bed can flow more smoothly, and the retention time can be adjusted with high accuracy.

According to one aspect of the present disclosure, there is provided an oxidation method for oxidizing a raw material containing at least one of carbonized coal and a torrefied biomass using an oxidation equipment having a main body unit, the method including: a gas supply step of supplying an oxygen-containing gas at 150° C. to 300° C. from a lower side to an upper side of the main body unit to form a fluidized bed in which the raw material flows; an oxidation step of oxidizing the raw material contained in the fluidized bed with the oxygen-containing gas in the main body unit; a cooling step of cooling an oxidized product obtained by oxidizing the raw material in a cooling unit; and a delivery step of delivering the oxidized product cooled in the cooling step from the cooling unit, in which the delivery step controls a delivery amount of the oxidized product based on a differential pressure between a pressure in a freeboard portion of the main body unit and a pressure in a portion of the main body unit through which the fluidized bed passes.

In the above-described oxidation method, the oxygen-containing gas at 150° C. to 300° C. is supplied from below to the top to form the fluidized bed in which the raw material flows and to oxidize the raw material contained in the fluidized bed. Since the oxygen-containing gas at 150° C. to 300° C. is used, functional groups contained in the raw material can be sufficiently oxidized. In addition, since the fluidized bed is formed, the oxygen-containing gas is sufficiently supplied from the gas supply unit to the vicinity of the raw material. Since a gas after an oxidation reaction is quickly replaced with the oxygen-containing gas, the oxygen concentration in the gas around the raw material can be maintained at a sufficiently high level. Accordingly, the diffusion rate of oxygen to the surface and inside of the raw material is maintained, and the gas-solid reaction rate can be sufficiently increased. In addition, since the delivery amount of the oxidized product is controlled based on the differential pressure between the pressure in the freeboard portion and the pressure in the portion through which the fluidized bed passes, the retention time can be flexibly controlled according to the properties of raw materials and the properties of modified fuels. Accordingly, the variations in oxidation can be reduced even if raw materials are of different types, such as carbonized coal and torrefied biomass, or raw materials are made into briquettes. Due to these factors, it is possible to smoothly oxidize a raw material in a short period of time and sufficiently reduce the variations in oxidation. In addition, since the diffusion rate of oxygen to the surface and inside of the raw material can be maintained, even if the raw material has a wide particle size distribution, it is possible to sufficiently reduce the variations in oxidation.

According to one aspect of the present disclosure, there is provided a method for producing a modified fuel from a raw material containing at least one of carbonized coal and a torrefied biomass using an oxidation equipment having a main body unit, the method including: a gas supply step of supplying an oxygen-containing gas at 150° C. to 300° C. from a lower side to an upper side of the main body unit to form a fluidized bed in which the raw material flows; an oxidation step of oxidizing the raw material contained in the fluidized bed with the oxygen-containing gas to obtain the modified fuel; a cooling step of cooling the modified fuel obtained by oxidizing the raw material in a cooling unit; and a delivery step of delivering the modified fuel cooled in the cooling step from the cooling unit, in which the delivery step controls a delivery amount of the modified fuel based on a differential pressure between a pressure in a freeboard portion of the main body unit and a pressure in a portion of the main body unit through which the fluidized bed passes.

In the above-described production method, the oxygen-containing gas at 150° C. to 300° C. is supplied from below to the top to form the fluidized bed in which the raw material flows and to oxidize the raw material contained in the fluidized bed. Since the oxygen-containing gas at 150° C. to 300° C. is used, functional groups contained in the raw material can be sufficiently oxidized. In addition, since the fluidized bed is formed, the oxygen-containing gas is sufficiently supplied from the gas supply unit to the vicinity of the raw material. Since a gas after an oxidation reaction is quickly replaced with the oxygen-containing gas, the oxygen concentration in the gas around the raw material can be maintained at a sufficiently high level. Accordingly, the diffusion rate of oxygen to the surface and inside of the raw material is maintained, and the gas-solid reaction rate can be sufficiently increased. In addition, since the delivery amount of the modified fuel is controlled based on the differential pressure between the pressure in the freeboard portion and the pressure in the portion through which the fluidized bed passes, the retention time can be flexibly adjusted according to the properties of raw materials and the properties of oxidized products. Accordingly, the variations in oxidation can be reduced even if raw materials are of different types, such as carbonized coal and torrefied biomass, or raw materials are made into briquettes. Due to these factors, it is possible to smoothly oxidize a raw material in a short period of time and sufficiently reduce the variations in oxidation of the modified fuel. Accordingly, the modified fuel with sufficiently reduced spontaneous heat generation can be smoothly produced in a short period of time. In addition, since the diffusion rate of oxygen to the surface and inside of the raw material can be maintained, even if a raw material having a wide particle size distribution is used, a modified fuel in which the variations in oxidation are sufficiently reduced can be produced.

Advantageous Effects of Invention

It is possible to provide an oxidation equipment and an oxidation method capable of smoothly performing oxidation of a raw material having spontaneous heat generation in a short period of time and sufficiently reducing variations in oxidation. In addition, it is possible to provide a method for producing an oxidized product in which modified fuel with sufficiently reduced spontaneous heat generation can be smoothly produced in a short period of time.

DESCRIPTION OF EMBODIMENTS

Figure 1:
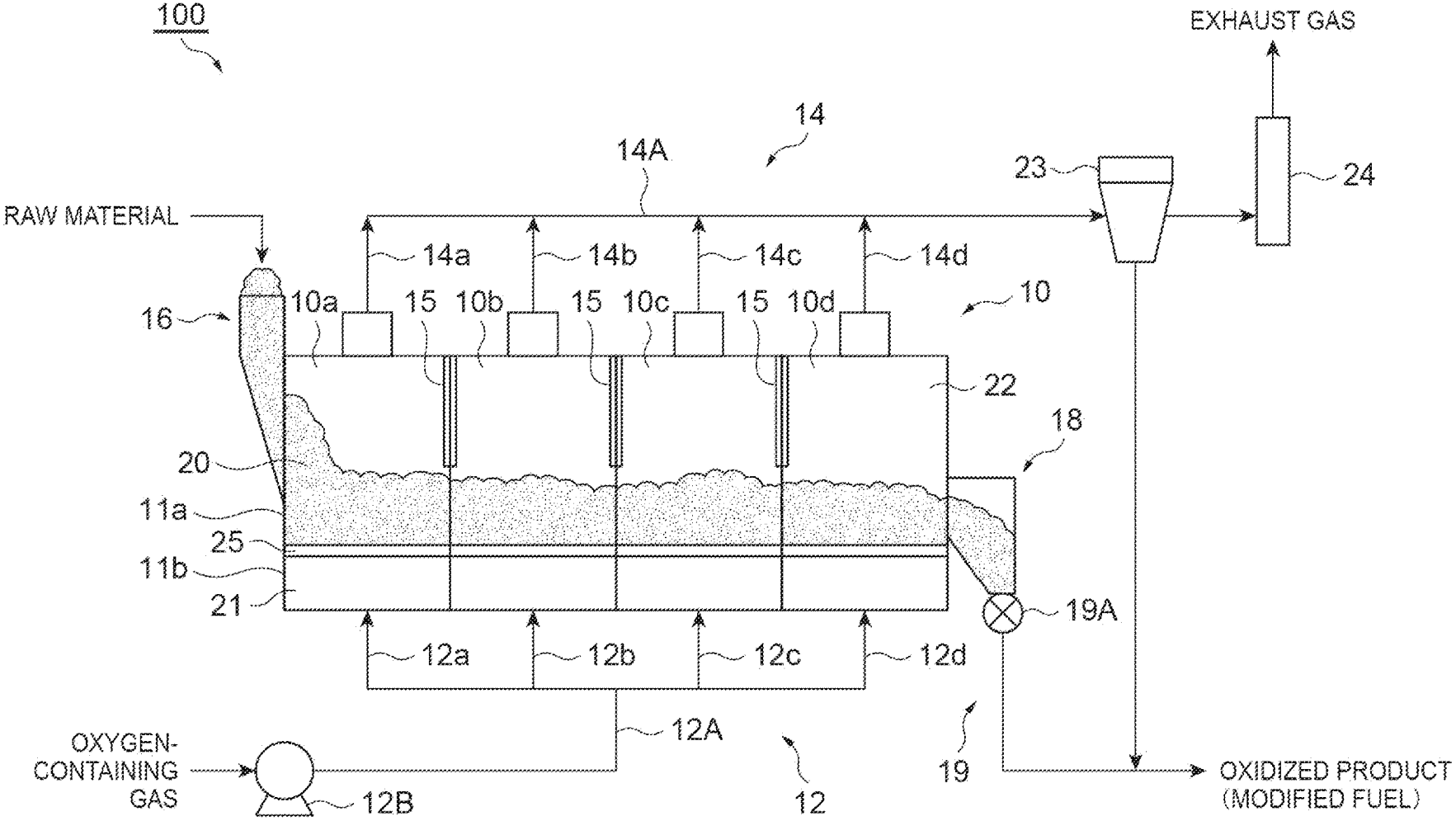
FIG. 1 is a view showing an oxidation equipment.

Hereinafter, embodiments of the present disclosure will be described with reference to the drawings. However, the following embodiments are merely examples for describing the present disclosure and are not intended to limit the present disclosure to the following contents. In the description, the same reference numerals are given to the same elements or elements having the same function, and description thereof will not be repeated according to circumstances. In addition, unless otherwise specified, positional relationships such as above, below, left of, and right of are based on the positional relationships illustrated in the drawing. Furthermore, the dimensional ratios of elements are not limited to the ratios shown in the drawings.

A oxidation equipment 100 of FIG. 1 includes: a main body unit 10 that forms a fluidized bed 20 for oxidizing a raw material while making it flow; a gas supply unit 12 that supplies an oxygen-containing gas at 150° C. to 300° C. from a lower portion of the main body unit 10 so that the raw material flows; a gas discharge unit 14 that discharges gas which has passed through the fluidized bed 20 from an upper portion of the main body unit 10; an introduction unit 16 that introduces the raw material into the main body unit 10; and a delivery unit 19 that delivers an oxidized product (modified fuel) obtained by oxidizing the raw material.

The raw material contains at least one of carbonized coal and torrefied biomass. Carbonized coal can be obtained through a carbonization step of carbonizing coal. In the carbonization step, coal is heated to a temperature range of 400° C. to 800° C. in an oxygen-free atmosphere. Thus, the volatile content of the coal can be reduced, and the calorific value can sufficiently increase. The coal may be low-grade coal containing at least one of lignite and sub-bituminous coal. Thus, the resources can be effectively utilized. Even if low-grade coal is used in this manner, a modified fuel with suppressed spontaneous heat generation can be produced using the oxidation equipment 100.

Biomass refers to resources delivered from organisms other than fossil fuels. Examples of biomass include thinned wood, pruned branches, wood waste, bark chips, other wood, bamboo, grass, coconut husk, palm oil residue, vegetables, fruits, food residue, and sludge.

Biomass may include woody biomass such as thinned wood, pruned branches, wood waste, bark chips, and other wood. Torrefied biomass can be obtained through a torrefaction process in which biomass is heated to a temperature of 200° C. to 450° C. (torrefaction temperature). The torrefaction process can be performed in a state in which contact with air is substantially or completely blocked. As facilities, for example, a vertical shaft furnace or a kiln may be used.

The term "torrefied" in the present disclosure refers to a state in which biomass is partly carbonized through carbonization, but not completely carbonized, and there is still room for carbonization. By maintaining the torrefied state without complete carbonization, it is possible to sufficiently secure the yield of torrefied biomass (carbonized product) and sufficiently effectively utilize the calorie inherent in biomass.

A raw material containing at least one of carbonized coal and torrefied biomass is introduced from the introduction unit 16 into the main body unit 10 (introduction step). Partition plates 15 are provided in an upper portion (freeboard portion 22) of an internal space of the main body unit 10. These partition plates 15 divide the internal space of the main body unit 10 into four zones 10*a*, 10*b*, 10*c*, and 10*d*. The four zones 10*a*, 10*b*, 10*c*, and 10*d* are arranged adjacent to each other along the flow direction of the raw material. Specifically, a first zone 10*a*, a second zone 10*b*, a third zone 10*c*, and a fourth zone 10*d* are arranged in this order from upstream to downstream. The raw material passes between lower ends of the partition plates 15 and a support member 25 placed in a lower portion of the main body unit 10 while forming a fluidized bed 20.

The gas supply unit 12 supplies an oxygen-containing gas from a lower portion of the main body unit 10 upward (gas supply step). The oxygen concentration of the oxygen-containing gas may be 13 volume % or less or 10 volume % or less from the viewpoint of suppressing rapid progress of an oxidation reaction of a raw material. The oxygen concentration of the oxygen-containing gas may be 3 volume % or more or 6 volume % or more from the viewpoint of promoting progress of the oxidation reaction of the raw material. The oxygen-containing gas may be, for example, a combustion gas obtained by burning a flammable gas generated in a carbonization step of coal and/or in a torrefaction process of biomass, or a mixed gas of an inert gas and air. The "volume %" for the oxygen concentration in the present disclosure is a volume ratio under standard conditions (25° C., 100 kPa).

The gas supply unit 12 of the oxidation equipment 100 has: a blower 12B for discharging the oxygen-containing gas to a main pipe 12A; and four branch pipes 12*a*, 12*b*, 12*c*, and 12*d* that branch from the main pipe 12A. The four branch pipes 12*a*, 12*b*, 12*c*, and 12*d* respectively supply the oxygen-containing gas to the zones 10*a*, 10*b*, 10*c*, and 10*d* of the main body unit 10. The oxygen-containing gas is supplied to each of the zones 10*a*, 10*b*, 10*c*, and 10*d* passing through a plenum chamber 21 in the lower portion of the main body unit 10 and the support member 25 in this order. The support member 25 forming a top plate of the plenum chamber 21 may be a perforated plate, a punching plate, a mesh plate, or a grating. This allows the oxygen-containing gas to pass vertically upward while supporting the raw material in the main body unit 10 so as not to fall into the plenum chamber 21. In this manner, the raw material is suspended by the oxygen-containing gas which passes through the support member 25 from below to the top and is blown from the lower portion of the main body unit 10 to form the fluidized bed 20.

The support member 25 may be configured to vibrate along the vertical direction or the horizontal direction by a vibration mechanism not shown in the drawing. As a result, the raw material (fluidized bed 20) can flow sufficiently smoothly, and the amount of oxygen-containing gas supplied into the main body unit 10 can be reduced. The vibration mechanism may be configured such that the support member 25 can vibrate. For example, a vibration source such as a vibration motor may be connected to the support member 25 or a lower portion 11*b* of the main body unit 10 to which the support member 25 is fixed. In this case, if an upper portion 11*a* and the lower portion 11*b* of the main body unit 10 are connected to each other with, for example, bellows or the like, vibration from the vibration source can be prevented from being transferred to the upper portion 11*a*.

The oxygen-containing gas supplied into the main body unit 10 has a temperature of 150° C. to 300° C. When such an oxygen-containing gas comes into contact with the raw material, functional groups contained in the raw material can be sufficiently oxidized (oxidation step). The temperature of the oxygen-containing gas supplied into the main body unit 10 may be 180° C. or higher from the viewpoint of further promoting oxidation. From the viewpoint of sufficiently maintaining the calorie of a modified fuel obtained by oxidizing the raw material, the temperature of the oxygen-containing gas supplied into the main body unit 10 may be 260° C. or lower or 240° C. or lower.

Since the raw material comes into contact with the oxygen-containing gas in the state of the fluidized bed 20, the gas after the oxidation reaction is quickly replaced with the oxygen-containing gas. For this reason, the oxygen concentration of the gas around the raw material can be maintained at a sufficiently high level.

Accordingly, the diffusion rate of oxygen to the surface and inside of the raw material is maintained, and the gas-solid reaction rate can be sufficiently increased.

In the fluidized bed 20, a reaction gas generated through a reaction between the oxygen-containing gas and the functional groups of the raw material is discharged to outside of the main body unit 10 through the gas discharge unit 14 connected to the upper portion of the main body unit 10 (gas discharge step). The gas discharged through the gas discharge unit 14 may contain an unreacted oxygen-containing gas. The gas discharge unit 14 has: four branch pipes 14*a*, 14*b*, 14*c*, and 14*d* respectively connected to the zones 10*a*, 10*b*, 10*c*, and 10*d*; and a main pipe 14A for joining the branch pipes. A collection unit 23 for collecting a solid content contained in the gas discharged from the gas discharge unit 14 is provided downstream of the gas discharge unit 14. Specifically, the main pipe 14A of the gas discharge unit 14 is connected to the collection unit 23. The collection unit 23 may have a bag filter and/or a cyclone.

The solid content collected by the collection unit 23 may be mixed with a modified fuel delivered from the delivery unit 19 or may be introduced from the introduction unit 16 again into the main body unit 10 (collection step). Thus, the raw material can be effectively utilized, and the yield of the modified fuel can be increased.

Depending on the degree of oxidation of the solid content collected by the collection unit 23, it may be selected whether to make the solid content join the modified fuel or the raw material. The gas from which the solid content is separated off in the collection unit 23 may be cleaned as necessary and then released to atmosphere through a chimney 24.

In the oxidation equipment 100, each of the zones 10*a*, 10*b*, 10*c*, and 10*d* divided by the partition plates 15 is provided with one of the branch pipes 12*a*, 12*b*, 12*c*, and 12*d* of the gas supply unit 12 and one of the branch pipes 14*a*, 14*b*, 14*c*, and 14*d* of the gas discharge unit 14. Thus, the operation conditions can be individually adjusted for each of the zones 10*a*, 10*b*, 10*c*, and 10*d*. For example, the temperature of each of the zones 10*a*, 10*b*, 10*c*, and 10*d* can be monitored to control the supply amount of the oxygen-containing gas supplied from any one of the branch pipes 12*a*, 12*b*, 12*c*, and 12*d* or to control the temperature at which the oxygen-containing gas is supplied. Thus, the reaction rate of the oxidation reaction can be adjusted with high accuracy. The branch pipes 12*a*, 12*b*, 12*c*, and 12*d* may be configured such that the temperature and the flow rate are independently controllable.

Figure 2:
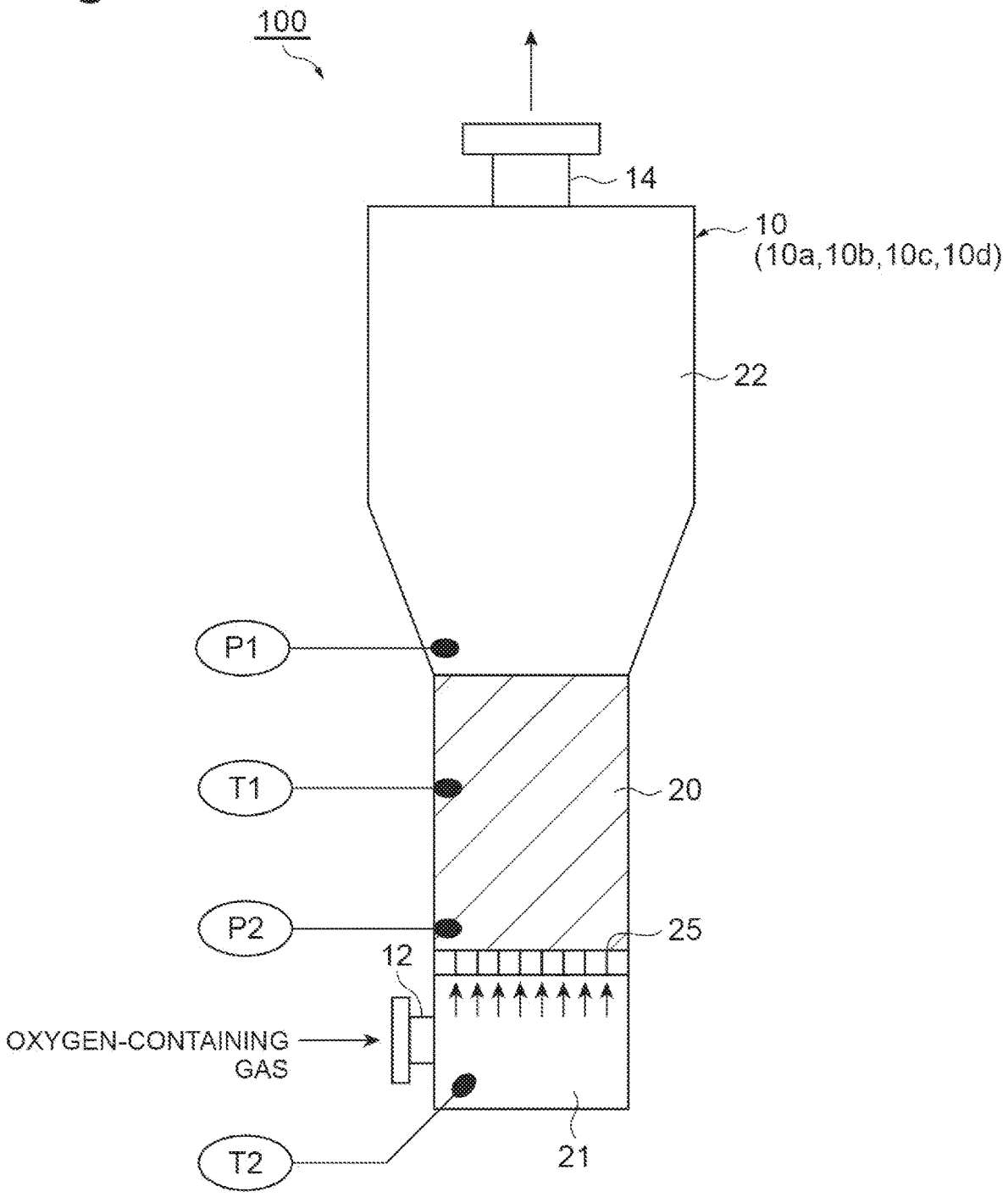
FIG. 2 is a view showing the inside of a main body unit when the oxidation equipment of FIG. 1 is viewed from the side.

As shown in FIG. 2, a first temperature measurement unit T1 for measuring the temperature of the fluidized bed 20 and a second temperature measurement unit T2 for measuring the temperature of the plenum chamber 21 are provided in the main body unit 10. The first temperature measurement unit T1 and the second temperature measurement unit T2 may be provided for each of the zones 10*a*, 10*b*, 10*c*, and 10*d*. Thus, the temperature can be monitored for each of the zones 10*a*, 10*b*, 10*c*, and 10*d* and can be controlled for each zone as necessary.

Returning to FIG. 1, a cooling unit 18 for cooling the oxidized product (modified fuel) obtained by oxidizing the raw material is provided downstream of the main body unit 10. The delivery unit 19 delivers the modified fuel from the cooling unit 18. The oxidized product obtained by oxidizing the raw material in the main body unit 10 has a high temperature (for example, 150° C. to 300° C.). For this reason, if the modified fuel is directly delivered from the main body unit 10 into atmosphere, spontaneous heat may be likely to be generated.

Therefore, by providing the cooling unit 18 for cooling the oxidized product between the main body unit 10 and the delivery unit 19, it is possible to suppress the spontaneous heat from being likely to be generated from the delivered oxidized product. The cooling unit 18 may cool the modified fuel with an inert gas or may cool the modified fuel using a heat exchanger (for example, water-cooling type). In the cooling unit 18, the modified fuel is cooled to, for example, 60° C. or lower (cooling step).

The delivery unit 19 has a delivery amount control unit 19A for controlling the amount of the oxidized product delivered. The delivery amount control unit 19A may be, for example, a rotary valve. The delivery amount control unit 19A controls the delivery amount of the oxidized product (modified fuel) based on a differential pressure between a pressure measured by a first pressure measurement unit P1 in FIG. 2 and a pressure measured by the second pressure measurement unit P2 in FIG. 2. By controlling the extracted amount of the oxidized product (modified fuel) in the delivery amount control unit 19A, the retention time of the oxidized product and the raw material in the main body unit 10 can be smoothly adjusted. The retention time may be controlled by changing the amount of the raw material introduced from the introduction unit 16.

As shown in FIG. 2, the main body unit 10 has the first pressure measurement unit P1 and the second pressure measurement unit P2 respectively in the freeboard portion 22 of each of the zones 10*a*, 10*b*, 10*c*, and 10*d* and in the portion through which the fluidized bed 20 passes. The height of the fluidized bed 20 in each of the zones 10*a*, 10*b*, 10*c*, and 10*d* can be measured by the differential pressure between the first pressure measurement unit P1 and the second pressure measurement unit P2. The retention time of the raw material in the main body unit 10 can be adjusted by controlling the amount of the modified fuel delivered from the delivery unit 19 based on the differential pressure between the first pressure measurement unit P1 and the second pressure measurement unit P2.

Figure 3:
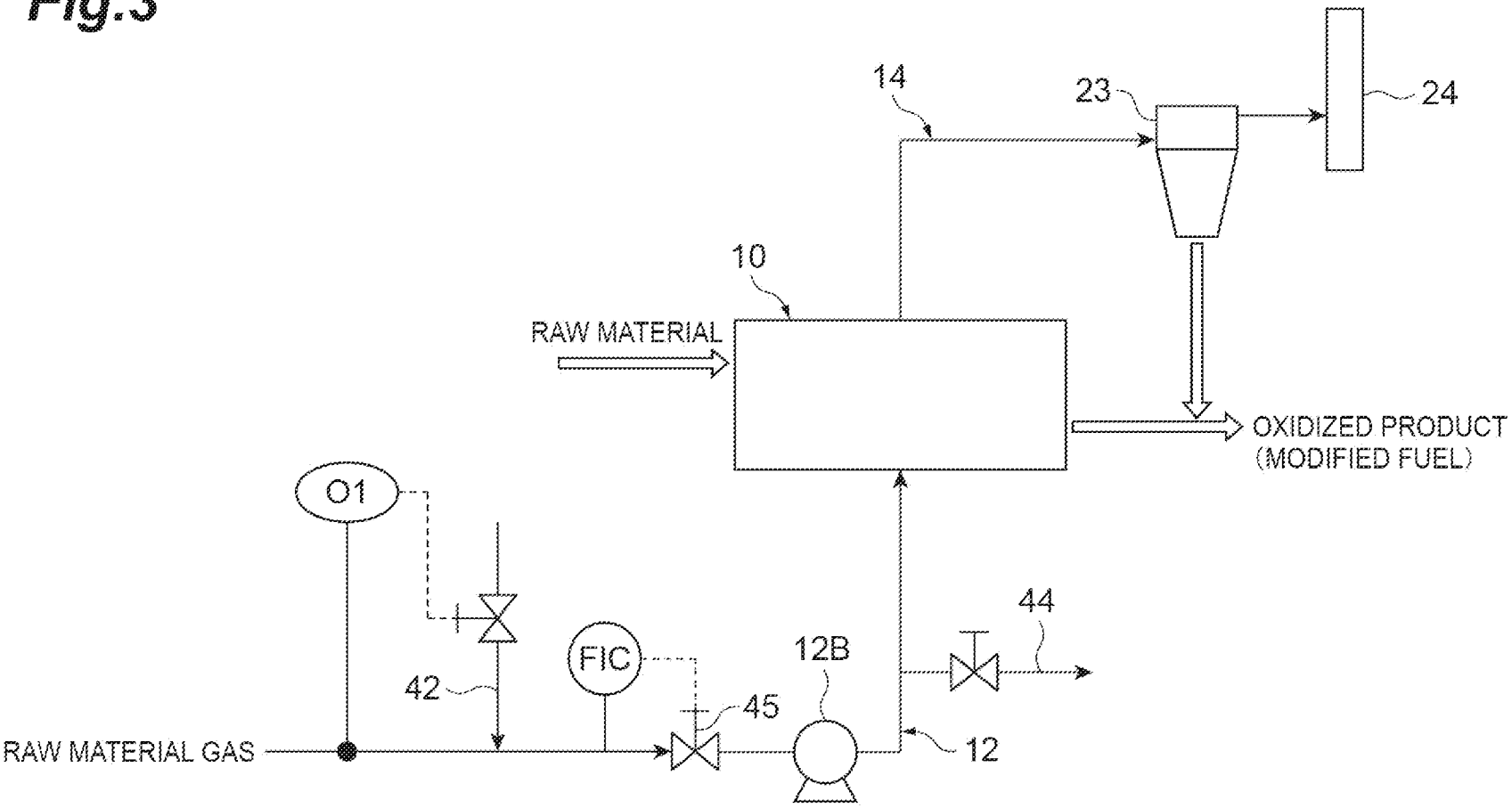
FIG. 3 is a view showing an example of a supply flow of an oxygen-containing gas.

As shown in FIG. 3, the gas supply unit 12 may have: a first oxygen concentration measurement unit O1 for measuring the oxygen concentration of a raw material gas; and an oxygen concentration control unit 42 for making a concentration controlling gas join the raw material gas based on measurement results of the first oxygen concentration measurement unit O1. The concentration controlling gas may be, for example, an inert gas or air. Thus, variations in oxygen concentration of the oxygen-containing gas supplied to the main body unit 10 can be suppressed. The gas supply unit 12 may further have a release unit 44 for releasing a part of the oxygen-containing gas to atmosphere. By having both a flow rate control unit 45 and such a release unit 44, the flow rate of the oxygen-containing gas supplied from the gas supply unit 12 to the main body unit 10 can be quickly controlled.

Figure 4:
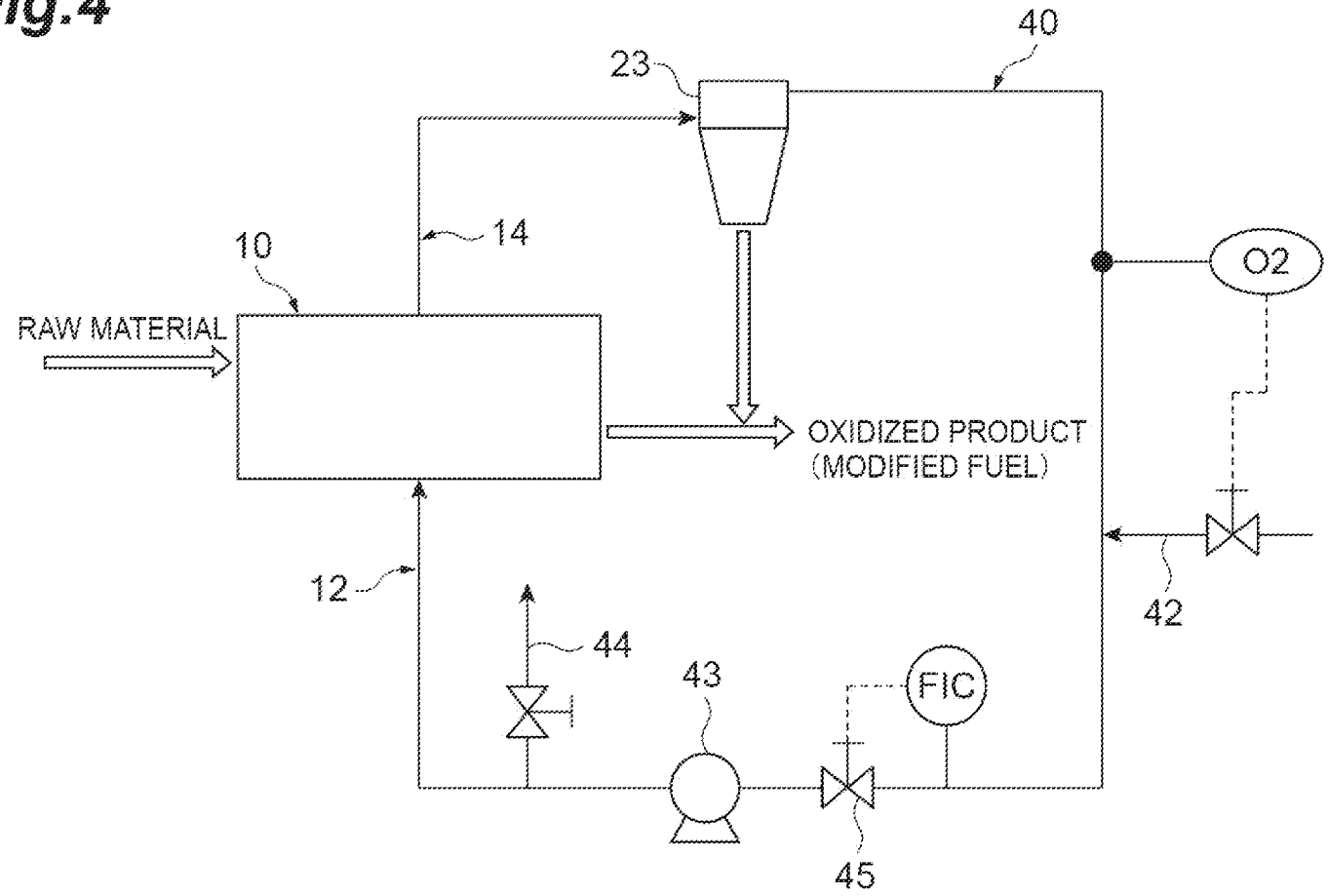
FIG. 4 is a view showing another example of a supply flow of an oxygen-containing gas.

A modification example of the oxidation equipment 100 has: as shown in FIG. 4, a circulation flow path 40 for circulating a gas discharged from a gas discharge unit 14 to a gas supply unit 12; and a second oxygen concentration measurement unit O2 for measuring the oxygen concentration of the circulation gas circulating in the circulation flow path 40. In this modification example, a collection unit 23 and the gas supply unit 12 are connected to each other via the circulation flow path 40. Based on measurement results of the second oxygen concentration measurement unit O2, a concentration controlling gas is supplied from the oxygen concentration control unit 42 to the circulation flow path 40, and the circulation gas circulating in the circulation flow path 40 is made to join the concentration controlling gas to obtain an oxygen-containing gas. In this manner, the oxygen concentration of the oxygen-containing gas supplied from the gas supply unit 12 can be controlled. By circulating the gas discharged from the gas discharge unit 14 in this manner, it is possible to promote effective use of the gas and reduce operating costs of the oxidation equipment (circulation step).

Since the oxidation equipment 100 and the modification example thereof includes a main body unit that forms a fluidized bed for oxidizing a raw material while making it flow, it is possible to smoothly oxidize the raw material in a short period of time and sufficiently reduce the variations in oxidation of the raw material. In addition, even if the raw material has a wide particle size distribution, it is possible to stably produce a modified fuel in which spontaneous heat generation is sufficiently reduced and variations in spontaneous heat generation are sufficiently reduced.

An average value of particle sizes of the raw material introduced from the introduction unit 16 shown in FIG. 1 may be, for example, 0.1 to 100 mm or 0.5 to 50 mm. The average value of the particle size is a particle size at which the cumulative weight ratio when the raw material is sieved to determine a particle size distribution is 50%. The raw material may be a briquette.

A cumulative value of oxidation calorific values (dry base) (DSC calorific value) generated when the raw material is held at 107° C. in air for 20 minutes may be 30 kJ/kg or more or 40 kJ/kg or more. In the oxidation equipment 100 and the modification example thereof, the spontaneous heat generation of such a raw material can be sufficiently reduced and the safety can be sufficiently improved. The above-described DSC calorific value of the oxidized product may be 10 kJ/kg or less or 5 kJ/kg or less.

The oxidized product obtained in the oxidation equipment 100 may be used as a solid fuel. Since functional groups contained in the raw material are oxidized, the oxidized product can also be called a modified fuel. Applications of the oxidized product are not limited to the solid fuel, and the oxidized product may be used for other applications.

An oxidation method according to one embodiment may be performed using the oxidation equipment 100 including the main body unit 10 for forming the fluidized bed 20 or the modification example of the oxidation equipment 100. The oxidation method of this case includes: an introduction step of introducing a raw material containing at least one of carbonized coal and torrefied biomass into the main body unit 10; a gas supply step of supplying an oxygen-containing gas at 150° C. to 300° C. from a lower side to an upper side of the main body unit 10 to form the fluidized bed 20 in which the raw material flows; an oxidation step of oxidizing the raw material contained in the fluidized bed 20 with the oxygen-containing gas in the main body unit 10; a cooling step of cooling an oxidized product obtained in the main body unit 10 in a cooling unit 18; a delivery step of delivering the oxidized product cooled in the cooling step from the cooling unit 18; a gas discharge step of discharging the gas from the gas discharge unit 14 to outside of the main body unit 10; and a collection step of collecting a solid content contained in the gas discharged in the gas discharge step in the collection unit 23. The delivery step controls the delivery amount of the oxidized product based on the differential pressure between a pressure in the freeboard portion 22 of the main body unit 10 and a pressure in a portion of the main body unit 10 through which the fluidized bed 20 passes. The delivery amount of the oxidized product can be controlled by the delivery amount control unit 19A. A modification example of the oxidation method may have a circulation step in which after the solid content is collected in the collection step from the gas discharged in the gas discharge step, the gas is reused as a part of the oxygen-containing gas in the gas supply step.

The oxidation method may be performed using a equipment other than the oxidation equipment 100 or the modification example thereof. In this case, the method may further have other steps, or may not have some of the above-described steps.

Since the oxygen-containing gas at 150° C. to 300° C. is used also in the above-described oxidation method, functional groups contained in the raw material can be sufficiently oxidized. In addition, since the fluidized bed 20 is formed, it is possible to smoothly oxidize the raw material in a short period of time and sufficiently reduce the variations in oxidation. In addition, even if the raw material has a wide particle size distribution, it is possible to sufficiently reduce the variations in oxidation.

A method for producing a modified fuel according to one embodiment may be performed using the oxidation equipment 100 including the main body unit 10 for forming the fluidized bed 20 or the modification example of the oxidation equipment 100. The method for producing a modified fuel of this case includes: an introduction step of introducing a raw material containing at least one of carbonized coal and torrefied biomass into the main body unit 10; a gas supply step of supplying an oxygen-containing gas at 150° C. to 300° C. from a lower side to an upper side of the main body unit 10 to form the fluidized bed 20 in which the raw material flows; an oxidation step of oxidizing the raw material contained in the fluidized bed 20 with the oxygen-containing gas in the main body unit 10; a cooling step of cooling a modified fuel obtained in the main body unit 10 in a cooling unit 18; a delivery step of delivering the modified fuel cooled in the cooling step from the cooling unit 18; a gas discharge step of discharging the gas from the gas discharge unit 14 to outside of the main body unit 10; and a collection step of collecting a solid content contained in the gas discharged in the gas discharge step in the collection unit 23. The delivery step controls the delivery amount of the modified fuel based on the differential pressure between a pressure in the freeboard portion 22 of the main body unit 10 and a pressure in a portion of the main body unit 10 through which the fluidized bed 20 passes. The delivery amount of the modified fuel can be controlled by the delivery amount control unit 19A. A modification example of the method for producing a modified fuel may have a circulation step in which after the solid content is collected in the collection step from the gas discharged in the gas discharge step, the gas is reused as a part of the oxygen-containing gas in the gas supply step.

The method for producing a modified fuel may be performed using a equipment other than the oxidation equipment 100 or the modification example thereof. In this case, the method may further have other steps, or may not have some of the above-described steps. Since the oxygen-containing gas at 150° C. to 300° C. is used also in the above-described production method, functional groups contained in the raw material can be sufficiently oxidized. In addition, since the fluidized bed 20 is formed, it is possible to sufficiently reduce the variations in oxidation of the modified fuel while smoothly oxidizing the raw material in a short period of time. In addition, even if the raw material has a wide particle size distribution, it is possible to produce a modified fuel in which the variations in oxidation are sufficiently reduced. In this manner, the modified fuel with sufficiently reduced spontaneous heat generation can be smoothly produced in a short period of time.

One embodiment of the present disclosure and modification examples have been described above, but the present disclosure is not limited to the above-described embodiments and modification examples.

For example, although the main body unit 10 of the oxidation equipment 100 has the four zones 10*a*, 10*b*, 10*c*, and 10*d*, the number of zones is not limited to four. In some other embodiments, a main body unit may not be divided into zones. That is, partition plates may not be provided.

EXAMPLES

The contents of the present disclosure will be described in more detail with reference to examples and comparative examples, but the present disclosure is not limited to the following examples.

Example 1

Carbonized coal obtained by carbonizing lignite was oxidized using the oxidation equipment having the structure as shown in FIG. 1. The oxygen concentration and the temperature of the oxygen-containing gas supplied from the gas supply unit into the main body unit were respectively set to 8 volume % and 200° C. The oxygen-containing gas was a mixed gas of oxygen and nitrogen. The retention time of the raw material (carbonized coal) in the main body unit was set to 40 minutes. Proximate analysis and ultimate analysis of the carbonized coal before the oxidation and the oxidized product (modified fuel) obtained through the oxidation were performed to measure the higher calorific value. The proximate analysis was performed in accordance with JIS M 8812:2006 "Coal and coke-Methods for proximate analysis." The ultimate analysis was performed in accordance with JIS M 8819:1997 "Coal and coke-Mechanical methods for ultimate analysis." The results were as shown in Tables 1 and 2. Each measurement result is a value on a dry basis.

Example 2

Oxidation was performed in the same manner as in Example 1 except that the temperature of the oxygen-containing gas supplied from the gas supply unit into the main body unit was set to 240° C. and the retention time in the main body unit was set to 70 minutes. Results of proximate analysis and ultimate analysis of the obtained oxidized product (modified fuel) were as shown in Tables 1 and 2.

Comparative Example 1

Oxidation was performed using carbonized coal in the same manner as in Example 1. Results of proximate analysis and ultimate analysis of this carbonized coal were as shown in Tables 1 and 2. The oxidation was performed using an external heating type rotary kiln (inner diameter: 250 mm, length: 400 mm). Carbonized coal was housed in the rotary kiln, and a mixed gas of oxygen and nitrogen (oxygen concentration: 8 volume %) was circulated at a flow rate of 30 to 50 $Nm^3/h$. The filling rate of the carbonized coal in the rotary kiln was 15 volume %. The temperature inside the rotary kiln was controlled to 200° C., and the oxidation was performed for 40 minutes while circulating the above-described mixed gas and rotating the rotary kiln. Results of proximate analysis and ultimate analysis of the obtained oxidized product (modified fuel) were as shown in Tables 1 and 2.

Comparative Example 2

Oxidation of carbonized coal was performed in the same manner as in Comparative Example 1 except that the temperature inside the rotary kiln was controlled to 240° C. and the time for the oxidation was set to 120 minutes. Results of proximate analysis and ultimate analysis of the obtained oxidized product (modified fuel) were as shown in Tables 1 and 2.

TABLE 1

| | Oxidation conditions | | Proximate analysis | | | |
|---|---|---|---|---|---|---|
| | Temperature [° C.] | Retention time [minute] | TM [wt %] | Ash [wt %] | VM [wt %] | FC [wt %] |
| Carbonized coal | — | — | 1.6 | 3.2 | 24.6 | 72.2 |
| Example 1 | 200 | 40 | 0.5 | 2.5 | 26.3 | 71.2 |
| Example 2 | 240 | 70 | 0.3 | 2.5 | 31.6 | 65.8 |
| Carbonized coal | — | — | 0.9 | 2.8 | 26.2 | 71.0 |
| Comparative Example 1 | 200 | 40 | 0.1 | 3.0 | 26.5 | 70.4 |
| Comparative Example 2 | 240 | 120 | <0.1 | 2.4 | 29.1 | 68.5 |

TABLE 2

| | Ultimate analysis | | | | | Calorific value |
|---|---|---|---|---|---|---|
| | C [wt %] | H [wt %] | N [wt %] | O [wt %] | S [wt %] | HHV [kcal/kg] |
| Carbonized coal | 84.3 | 3.7 | 0.9 | 13.4 | 0.3 | 7213 |
| Example 1 | 82.9 | 3.5 | 0.9 | 15.1 | 0.3 | 7053 |
| Example 2 | 75.1 | 2.6 | 0.8 | 21.2 | 0.3 | 6450 |
| Carbonized coal | 79.7 | 3.4 | 0.9 | 16.7 | 0.3 | 7182 |
| Comparative Example 1 | 79.4 | 3.4 | 1.0 | 17.4 | 0.3 | 6912 |
| Comparative Example 2 | 78.3 | 3.1 | 1.0 | 19.1 | 0.3 | 6864 |

Example 1 and Comparative Example 1 have the same oxidation temperature and retention time. Comparing the difference (A) in oxygen concentration between each carbonized coal as a raw material and each oxidized product after the oxidation, it was confirmed that the oxidation proceeded more in Example 1 in which a fluidized bed was used than that in Comparative Example 1 in which a rotary kiln was used (Example 1: Δ=1.7 weight %, Comparative Example 1: Δ=0.7 weight %). In addition, although the retention time in Example 2 was shorter than that in Comparative Example 2, it was confirmed that the oxidation proceeded sufficiently in Example 2 (Example 2: Δ=7.8 weight %, Comparative Example 2: Δ=2.4 weight %). From these results, it was confirmed that the oxidation of carbonized coal proceeded more smoothly in the fluidized bed than that in the rotary kiln.

Figure 5:
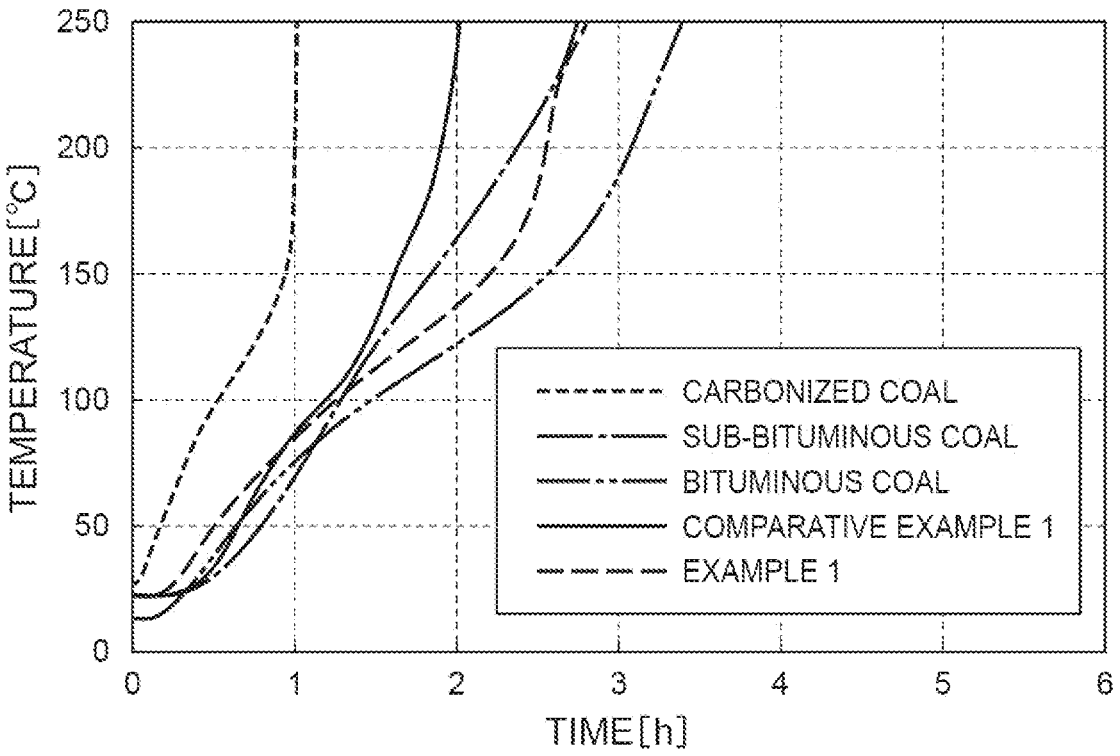
FIG. 5 is a graph showing results of pyrophoricity evaluation tests of oxidized products.
Figure 6:
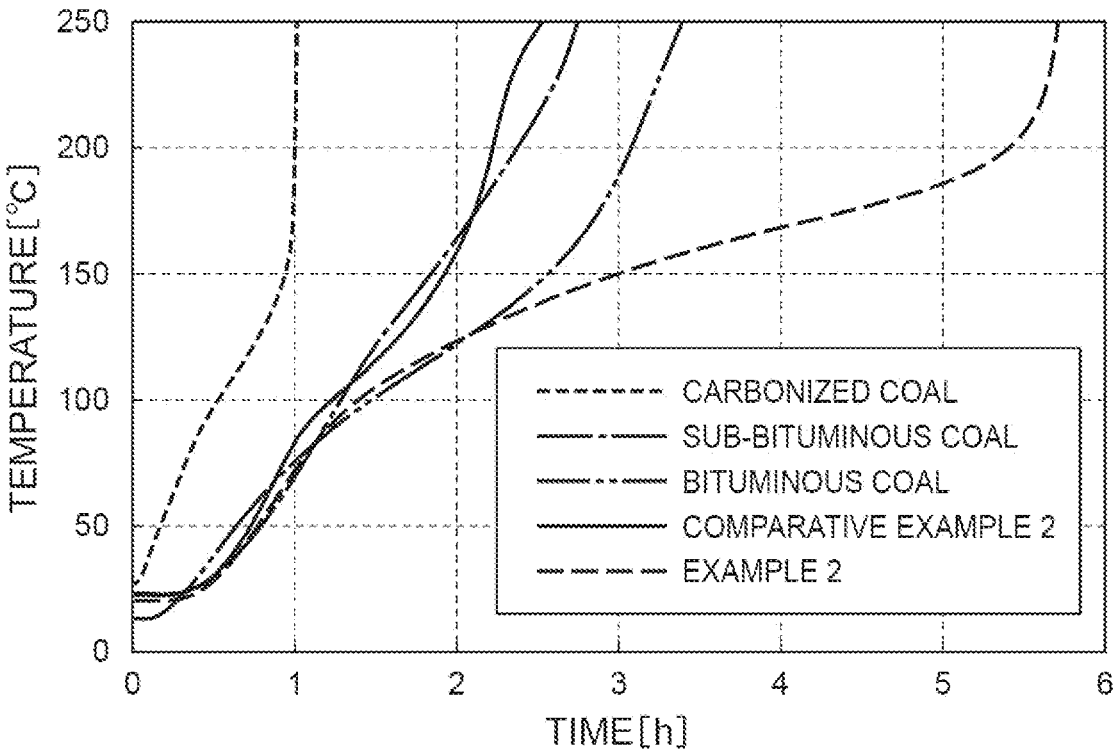
FIG. 6 is a graph showing results of pyrophoricity evaluation tests of oxidized products.

The calorific values of each example, each comparative example, and the carbonized coal which was used as raw material were evaluated. Specifically, the resulting oxidized products were subjected to a pyrophoricity evaluation test through a method according to the United Nations Recommendation on the Transport of Dangerous Goods Test [Class 4, Division 4.2 (Substances liable to spontaneous combustion, •Self-heating substances)]. In this test, each oxidized product or carbonized coal was placed in a cubic container which is formed of a wire net and has one side of 10 cm and stored in air at 140° C. to examine change in heat generation temperature over time. Results of Example 1 and Comparative Example 1 were as shown in FIG. 5. Results of Example 2 and Comparative Example 2 were as shown in FIG. 6. FIGS. 5 and 6 also concurrently show results of carbonized coal used in Examples 1 and 2 as a raw material, and sub-bituminous coal and bituminous coal which had not been carbonized for comparison. As shown in FIGS. 5 and 6, it was confirmed that the heat generation properties are more sufficiently suppressed in the oxidized products of Examples 1 and 2 than those in the oxidized products of Comparative Examples 1 and 2.

Reference Example 1

Figure 7:
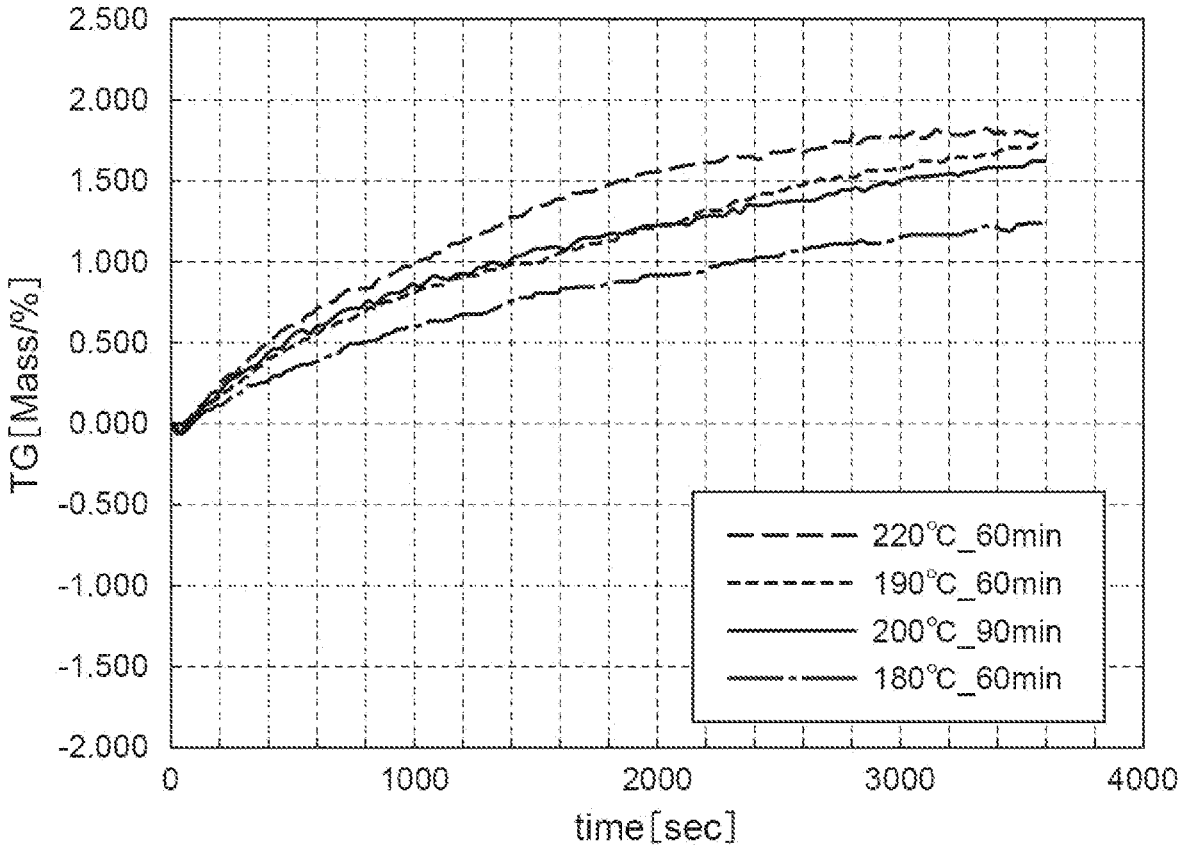
FIG. 7 is a graph showing change in weight change ratio of Reference Example 1 over time.
Figure 8:
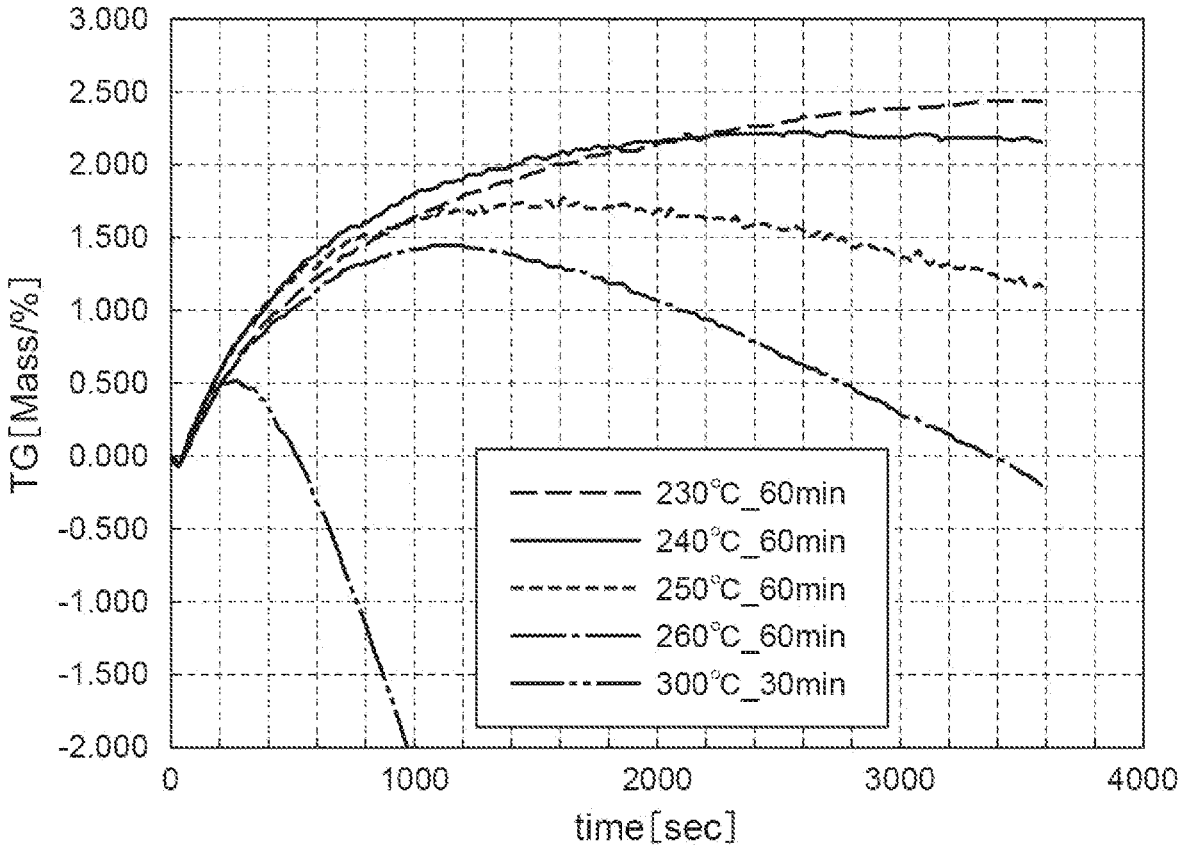
FIG. 8 is a graph showing change in weight change ratio of Reference Example 1 over time.

Each carbonized coal (about 10 mg) obtained by carbonizing lignite was subjected to oxidation, and the weight change due to oxygen adsorption was measured. A TG-DSC tester (manufactured by NETZSCH, STA449F3) was used to measure the weight change ratio by performing heating at temperatures shown in Table 3 while supplying an oxygen-containing gas with a constant oxygen concentration. The heating time was as shown in Table 3. The measurement results of the weight change ratio were as shown in FIGS. 7 and 8 and Table 3. From these results, it was confirmed that the oxidation proceeded sufficiently at a temperature of about 180° C. It was found that, if the temperature is too high, a weight loss occurs. It is thought that this is due to thermal decomposition.

TABLE 3

| | Heating time | | | |
|---|---|---|---|---|
| Temperature | 15 min | 30 min | 60 min | 90 min |
| 180° C. | | | +1.2% | |
| 190° C. | | | +1.8% | +2.2% |
| 200° C. | | | +1.8% | +1.6% |
| 210° C. | +1.2% | +1.6% | | +2.2% |
| 220° C. | | | +1.8% | |
| 230° C. | +1.5% | +1.8% | +2.3% | |
| 240° C. | | +1.5% | +2.2% | |
| 250° C. | | | +1.2% | |
| 260° C. | +1.6% | +1.3% | −0.2% | |
| 300° C. | | −6.2% | | |

Reference Example 2

DSC calorific values of the oxidized products obtained in Reference Example 1 were measured. Each weighed sample was placed in a sample holder of a TG-DSC tester, and the temperature was raised from 20° C. to 107° C. at 3° C./min in a nitrogen atmosphere (nitrogen gas flow rate: 100 mL/min). After the temperature reached 107° C., the nitrogen gas was replaced with air (flow rate: 100 mL/min). After the replacement, the oxidation calorific values (dry base) were measured while each sample was held for 20 minutes (for 1200 seconds). Integrated values of the oxidation calorific values measured in this manner (hereinafter referred to as "DSC calorific values") were as shown in Table 4 (the unit of the numerical values in Table 4 is "kJ/kg_dry"). The DSC calorific value of carbonized coal before oxidation was 54.6 kJ/kg_dry. On the other hand, all of the oxidized products in Table 4 showed significantly small DSC calorific values.

TABLE 4

| | Heating time | | | |
|---|---|---|---|---|
| Temperature | 15 min | 30 min | 60 min | 90 min |
| 180° C. | | | 6.7 | |
| 190° C. | | | 5.6 | 5.0 |
| 200° C. | | | 5.5 | 6.6 |
| 210° C. | 10.0 | 6.1 | | 5.2 |
| 220° C. | | | 5.6 | |
| 230° C. | 8.0 | 5.9 | 5.3 | |
| 240° C. | | 7.7 | 4.3 | |
| 250° C. | | | 6.6 | |
| 260° C. | 8.9 | 7.1 | 5.1 | |
| 300° C. | | 5.9 | | |

Example 3

Carbonized coal was subjected to oxidation using an oxidation equipment having the same structure as that of the oxidation equipment of FIG. 1 except that the cooling unit 18 was not provided. Carbonized coal was prepared by heating lignite at 540° C. for 1 hour in an oxygen-free atmosphere. The carbonized coal was continuously introduced from the introduction unit into the main body unit 10 at an introduction rate of 50 to 60 kg/h to oxidize the carbonized coal. The temperature of an oxygen-containing gas supplied to the main body unit 10 was set to 170° C. to 180° C., and the oxygen concentration was set to 7 to 8 volume %. The flow rate of the oxygen-containing gas supplied to the main body unit 10 was set to 2,400 $Nm^3/h$, and the flow rate was set to 2.5 m/sec. The retention time of the carbonized coal in the main body unit 10 was set to 100 minutes.

Oxidized product samples were collected from a fluidized bed flowing the third zone 10*c* and the fourth zone 10*d*, and the DSC calorific values were measured. The measurement was performed in the same procedure as in Reference Example 2. The DSC calorific values of the carbonized coal before the oxidation and the oxidized product delivered from the delivery unit were also measured. The oxidized product delivered from the delivery unit was sieved using a sieve with mesh openings of 2 mm, and the DSC calorific values of an over-size product and an under-size product were measured. The results were as shown in Table 5.

Example 4

The same oxidation equipment as that of Example 3 was used to oxidize the oxidized product (before being sieved) delivered from the delivery unit in Example 3 again. The temperature of an oxygen-containing gas supplied to the main body unit 10 was set to 170° C. to 190° C., and the retention time of the oxidized product in the main body unit 10 was set to 100 minutes. Other operation conditions were the same as those in Example 3.

Similarly to Example 3, oxidized product samples were collected from a fluidized bed flowing the third zone 10*c* and the fourth zone 10*d*, and the DSC calorific values were measured. The DSC calorific values of the oxidized products (over-size product and under-size product) delivered from the delivery unit were measured in the same manner as in Example 3. The results were as shown in Table 5.

Example 5

Oxidation was performed in the same manner as in Example 3 using torrefied biomass (pine) instead of the carbonized coal. Torrefied biomass was prepared by heating pine at 340° C. for 1 hour in an oxygen-free atmosphere. The torrefied biomass was continuously introduced from the introduction unit into the main body unit 10 at an introduction rate of 50 to 60 kg/h to oxidize the torrefied biomass. The temperature of an oxygen-containing gas supplied to the main body unit was set to 160° C. to 170° C., and the oxygen concentration was set to 6 to 8 volume %. The flow rate of the oxygen-containing gas supplied to the main body unit 10 was set to 1,000 $Nm^3/h$, and the flow rate was set to 1.0 m/sec. The retention time of the torrefied biomass in the main body unit 10 was set to 62 minutes.

Oxidized product samples were collected from a fluidized bed flowing the second zone 10*b*, the third zone 10*c*, and the fourth zone 10*d*, and the DSC calorific values were measured. The measurement was performed in the same procedure as in Reference Example 2. The DSC calorific values of the torrefied biomass before the oxidation and the oxidized product delivered from the delivery unit were also measured. The results were as shown in Table 5.

Example 6

The same oxidation equipment as that of Example 5 was used to oxidize the oxidized product delivered from the delivery unit in Example 5 again. The temperature of an oxygen-containing gas supplied to the main body unit 10 was set to 200° C. to 210° C., and the retention time of the oxidized product in the main body unit 10 was set to 62 minutes. Other operation conditions were the same as those in Example 5. The DSC calorific values of the oxidized products delivered from the delivery unit were measured in the same manner as in Example 5. The results were as shown in Table 5.

TABLE 5

| | Raw material | Second zone 10b | Third zone 10c | Fourth zone 10d | Delivery unit | Collection unit |
|---|---|---|---|---|---|---|
| Example 3 | 55 | | 15 (55 min) | 21 (80 min) | 21 (100 min)<br>21 (100 min) | |
| Example 4 | | | 7 (155 min) | 6 (180 min) | 9 (200 min)<br>9 (200 min) | 5 |
| Example 5 | 52 | 9 (20 min) | 9 (35 min) | 10 (50 min) | 12 (62 min) | |
| Example 6 | | | | | 3 (124 min) | |

The unit of the numbers shown in Table 5 is [KJ/kg_dry]. The numerical values in the parentheses indicate total retention times in the main body unit 10. As for the results of the "Delivery unit" of Examples 3 and 4, the upper stage is an over-size product and the lower stage is an under-size product. The numerical value for the collection unit in Example 4 is a DSC calorific value of the solid content collected by a bag filter.

As shown in FIG. 5, it was confirmed that the spontaneous heat generation can be sufficiently reduced by prolonging retention time in the main body unit 10. In Examples 4 and 5, the DSC calorific values of the samples obtained in each delivery unit were higher than those obtained in the fourth zone 10*d*. It is inferred that this is because oxidation rapidly progressed in atmosphere immediately after delivery, thereby causing an oxidative decomposition reaction and exposing a new functional group on the surface of each sample, and as a result, the spontaneous heat generation increased again. To suppress such a phenomenon, it is thought that it is effective to cool the oxidized product before the delivery by providing a cooling unit downstream of the main body unit.

Reference Example 3

Lignite was heated at 480° C. for 1 hour in an oxygen-free atmosphere for carbonization to obtain three types of carbonized coal pieces 50*a*, 50*b*, and 50*c* having different particle diameters. All of these carbonized coal pieces had a higher calorific value of 7,000 kcal/kg and a DSC calorific value of 40.6 kJ/kg.

Carbonized coal 50*a* . . . Particle diameter: about 0.1 mm

Carbonized coal 50*b* . . . Particle diameter: 2 to 3 mm

Carbonized coal 50*c* . . . Briquette (10 mm×10 mm×20 mm)

Figure 9:
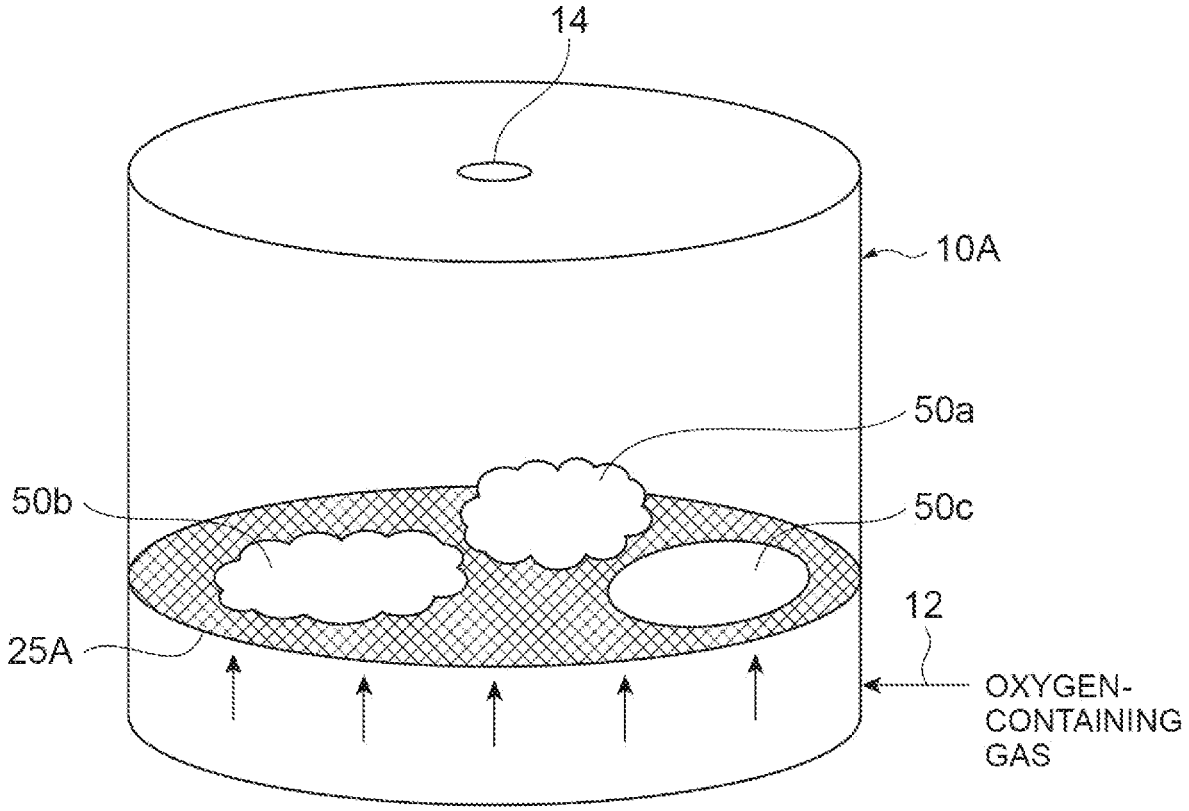
FIG. 9 is a view for illustrating an oxidation equipment which is used in Reference Examples 3, 4, and 5.

As shown in FIG. 9, a test container 10A having a cylindrical outer shape was prepared. A perforated mesh 25A was installed inside the test container 10A, and the carbonized coal pieces 50*a*, 50*b*, and 50*c* were placed on the perforated mesh 25A. Thereafter, the test container 10A in which the carbonized coal pieces 50*a*, 50*b*, and 50*c* were housed was placed in a constant-temperature tank. An oxygen-containing gas was supplied from the gas supply unit 12 into the test container 10A to perform oxidation. The temperature and the oxygen concentration of the oxygen-containing gas and the oxidation time were as shown in Table 6. DSC calorific values of each of the oxidized products obtained were measured. The results were as shown in Table 6 and FIG. 10.

TABLE 6

| Oxidation | | | DSC Calorific value [kJ/kg_dry] | | |
|---|---|---|---|---|---|
| Temperature | Oxygen concentration | Time | Carbonized coal 50a | Carbonized coal 50b | Carbonized coal 50c |
| 220° C. to 210° C. | 6.0 to 8.0 volume % | 15 min | 17.5 | 11.8 | 15.8 |
| ↓ | ↓ | 30 min | 10.0 | 12.3 | 11.1 |
| ↓ | ↓ | 60 min | 12.4 | 9.5 | 6.3 |
| ↓ | ↓ | 90 min | 11.9 | 8.1 | 8.9 |
| ↓ | ↓ | 180 min | 7.3 | 8.2 | 5.0 |

Reference Example 4

Lignite was heated at 540° C. for 1 hour in an oxygen-free atmosphere for carbonization to obtain three types of carbonized coal pieces 51*a*, 51*b*, and 51*c* having different particle diameters. All of these carbonized coal pieces had a higher calorific value of 7,490 kcal/kg and a DSC calorific value of 44.8 kJ/kg_dry.

Carbonized coal 51*a* . . . Particle diameter: about 0.1 mm

Carbonized coal 51*b* . . . Particle diameter: 2 to 3 mm

Carbonized coal 51*c* . . . Briquette (10 mm×10 mm×20 mm)

Oxidation was performed in the same method as in Reference Example 3 except that the carbonized coal pieces 51*a*, 51*b*, and 51*c* were used instead of the carbonized coal pieces 50*a*, 50*b*, and 50*c*. The temperature and the oxygen concentration of the oxygen-containing gas and the oxidation time were as shown in Table 7. DSC calorific values of each of the oxidized products obtained were measured. The results were as shown in Table 7 and FIG. 11.

TABLE 7

| Oxidation | | | DSC Calorific value [kJ/kg_dry] | | |
|---|---|---|---|---|---|
| Temperature | Oxygen concentration | Time | Carbonized coal 51a | Carbonized coal 51b | Carbonized coal 51c |
| 200° C. to 210° C. | 6.0 to 8.0 volume % | 15 min | 11.9 | 12.2 | 11.1 |
| ↓ | ↓ | 30 min | — | 6.9 | 7.7 |
| ↓ | ↓ | 60 min | — | 8.0 | 4.6 |
| ↓ | ↓ | 90 min | 5.3 | 5.9 | 9.2 |

Reference Example 5

Eucalyptus was heated at 380° C. for 1 hour in an oxygen-free atmosphere for carbonization to obtain two types of torrefied biomass pieces 52*a* and 52*b* having different particle diameters. All of these torrefied biomass pieces had a higher calorific value of 6,760 kcal/kg and a DSC calorific value of 35.2 kJ/kg_dry.

Torrefied biomass 52*a* . . . Particle diameter: about 0.1 mm

Torrefied biomass 52*b* . . . Particle diameter: 2 to 3 mm

Oxidation was performed in the same method as in Reference Example 3 except that the torrefied biomass pieces 52*a* and 52*b* were used instead of the carbonized coal pieces 50*a*, 50*b*, and 50*c*. The temperature and the oxygen concentration of the oxygen-containing gas and the oxidation time were as shown in Table 8. DSC calorific values of each of the oxidized products obtained were measured. The results were as shown in Table 8 and FIG. 12.

TABLE 8

| Oxidation | | | DSC Calorific value [kJ/kg_dry] | |
|---|---|---|---|---|
| Temperature | Oxygen concentration | Time | Torrefied biomass 52a | Torrefied biomass 52b |
| 180° C. | 8.0 volume % | 15 min | 4.7 | 6.6 |
| ↓ | ↓ | 30 min | 4.8 | 4.2 |

Figure 10:
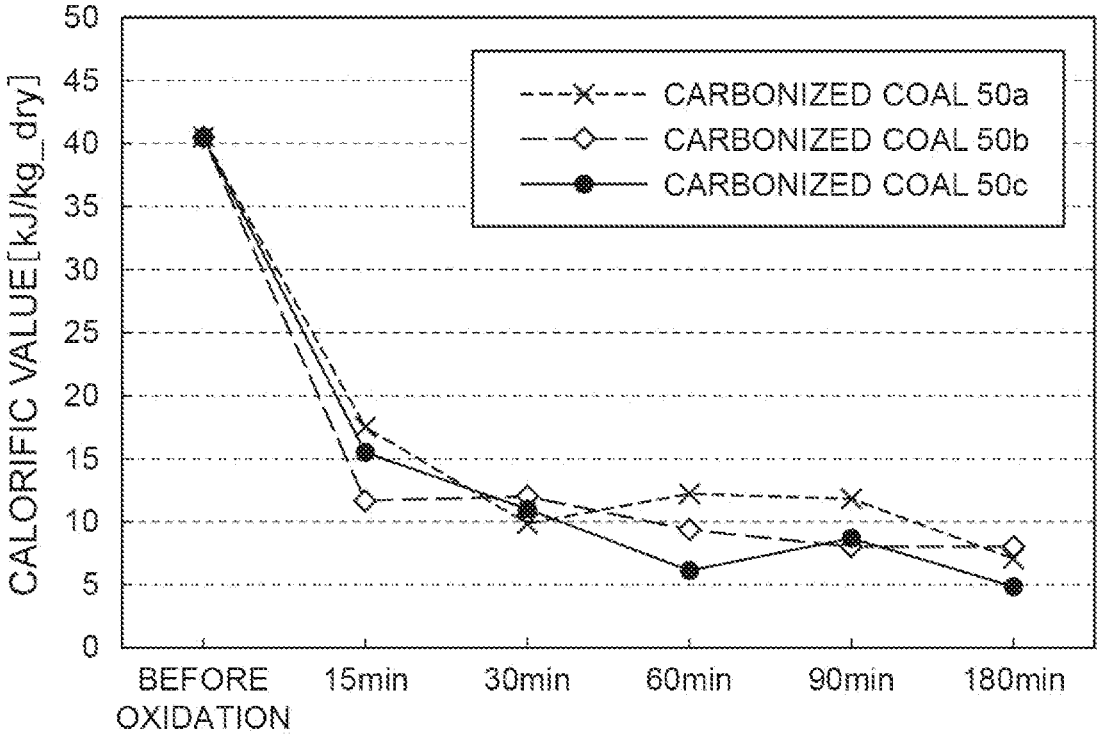
FIG. 10 is a graph showing measurement results of DSC calorific values of Reference Example 3.
Figure 11:
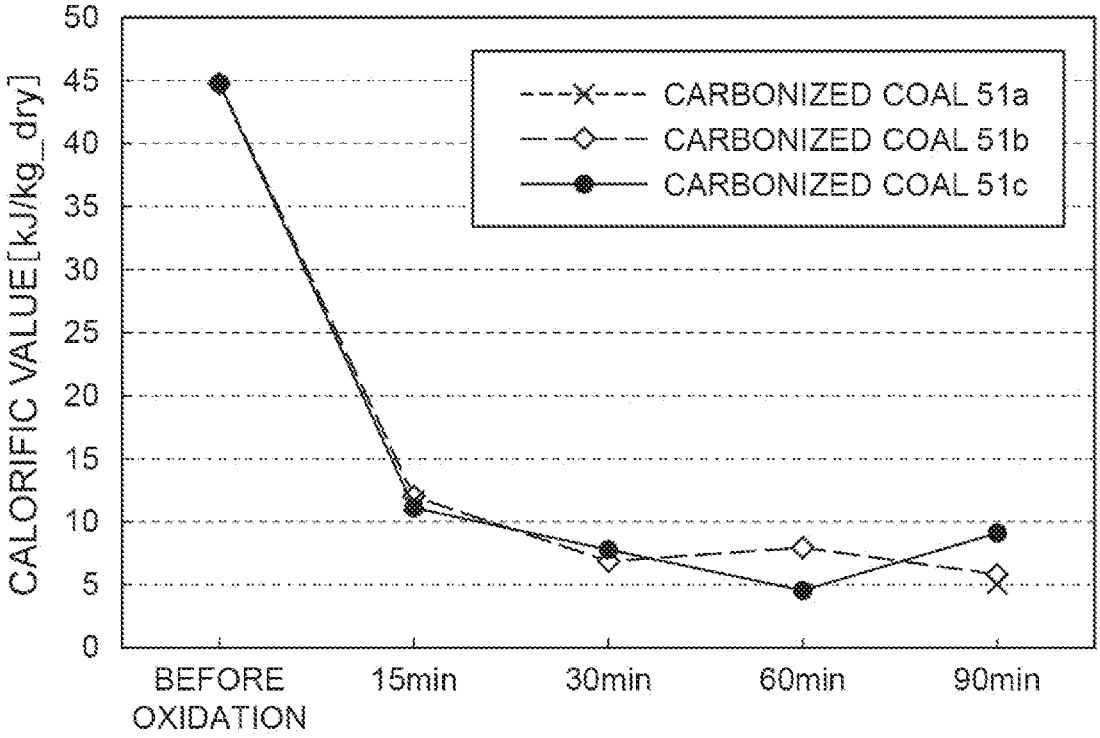
FIG. 11 is a graph showing measurement results of DSC calorific values of Reference Example 4.
Figure 12:
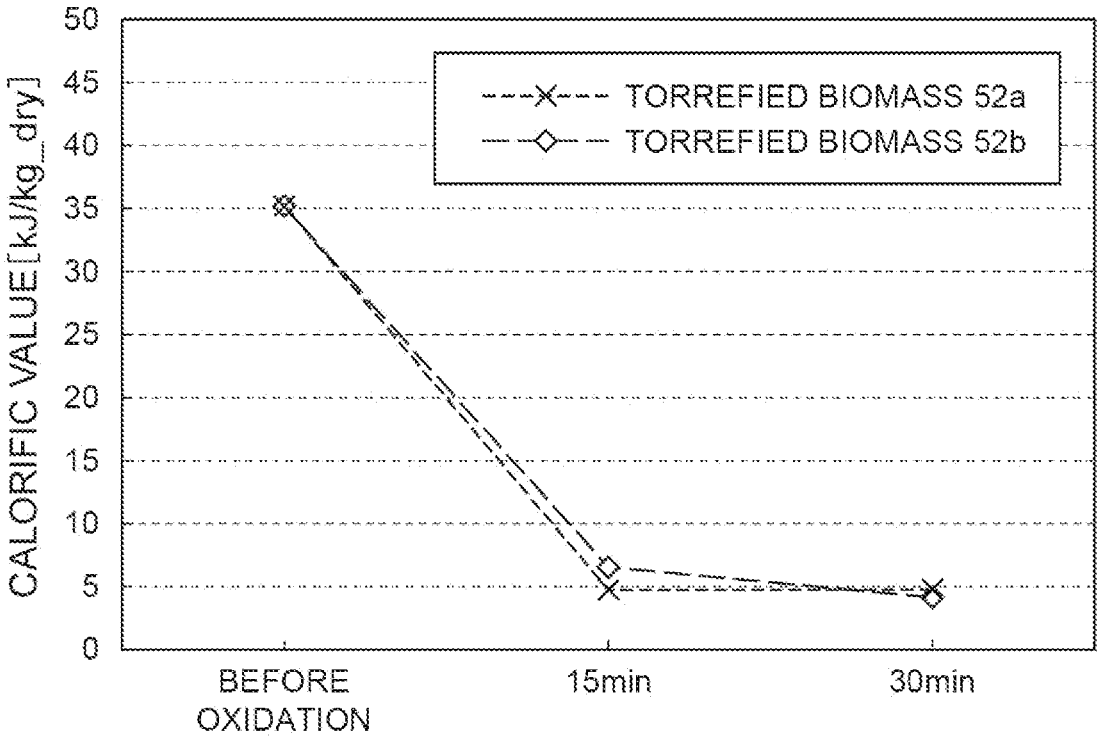
FIG. 12 is a graph showing measurement results of DSC calorific values of Reference Example 5.

As shown in Tables 6 to 8 and FIGS. 10 to 12, it was confirmed that, even if the carbonized coal pieces and the torrefied biomass pieces have different particle sizes, the oxidation proceeded sufficiently and the spontaneous heat generation was reduced. Accordingly, even if the raw material has a wide particle size distribution, it is possible to sufficiently reduce the variations in oxidation.

INDUSTRIAL APPLICABILITY

It is possible to provide an oxidation equipment and an oxidation method capable of smoothly performing oxidation of a raw material having spontaneous heat generation in a short period of time and sufficiently reducing variations in oxidation. In addition, it is possible to provide a method for producing an oxidized product in which modified fuel with sufficiently reduced spontaneous heat generation can be smoothly produced in a short period of time.

REFERENCE SIGNS LIST

10: Main body unit; 10A: Test container; 10*a*: First zone (zone); 10*b*: Second zone (zone); 10*c*: Third zone (zone); 10*d*: Fourth zone (zone); 11*a*: Upper portion; 11*b*: Lower portion; 12: Gas supply unit; 12A, 14A: Main pipe; 12B: Blower; 12*a*, 12*b*, 12*c*, 12*d*, 14*a*, 14*b*, 14*c*, 14*d*: Branch pipe; 14: Gas discharge unit; 15: Partition plate; 16: Introduction unit; 18: Cooling unit; 19: Delivery unit; 19A: Delivery amount control unit; 20: Fluidized bed; 21: Plenum chamber; 22: Freeboard portion; 23: Collection unit; 24: Chimney; 25: Support member; 25A: Perforated mesh; 40: Circulation flow path; 42: Oxygen concentration control unit; 44: Release unit; 45: Flow rate control unit; 50*a*, 50*b*, 50*c*: Carbonized coal; 100: Oxidation equipment; O1: First oxygen concentration measurement unit; O2: Second oxygen concentration measurement unit; P1: First pressure measurement unit; P2: Second pressure measurement unit; T1: First temperature measurement unit; T2: Second temperature measurement unit

The invention claimed is:

1. Oxidation equipment for oxidizing a raw material containing at least one of carbonized coal and a torrefied biomass, the equipment comprising:

a main body unit configured to form a fluidized bed for oxidizing the raw material while making it flow;

a gas supply unit configured to supply an oxygen-containing gas at 150° C. to 300° C. from a lower portion of the main body unit so that the raw material flows;

a gas discharge unit configured to discharge gas which has passed through the fluidized bed from the main body unit;

a cooling unit configured to cool an oxidized product obtained by oxidizing the raw material downstream of the main body unit; and a delivery unit configured to deliver the oxidized product from the cooling unit, wherein the main body unit has a first pressure measurement unit in a freeboard portion above the fluidized bed and a second pressure measurement unit in a portion through which the fluidized bed passes, and wherein the delivery unit has a delivery amount control unit that controls a delivery amount of the oxidized product from the cooling unit based on a differential pressure between a pressure measured by the first pressure measurement unit and a pressure measured by the second pressure measurement unit.

2. The oxidation equipment according to claim 1, wherein the raw material contains the torrefied biomass.

3. The oxidation equipment according to claim 1, wherein the cooling unit cools the oxidized product to 60° C. or lower with an inert gas.

4. The oxidation equipment according to claim 1, further comprising:

a partition plate configured to divide an upper portion of an internal space of the main body unit into a plurality of parts, wherein a plurality of zones divided by the partition plate are arranged to be adjacent to each other along a flow direction of the raw material.

5. The oxidation equipment according to claim 4, which has a configuration in which a temperature of each of the plurality of zones is individually controllable.

6. The oxidation equipment according to claim 1, further comprising:

an oxygen concentration control unit configured to control an oxygen concentration of the oxygen-containing gas to 13 volume % or less.

7. The oxidation equipment according to claim 1, further comprising:

a circulation flow path configured to circulate the gas discharged from the gas discharge unit to the gas supply unit;

an oxygen concentration measurement unit configured to measure an oxygen concentration of a circulation gas circulating in the circulation flow path; and an oxygen concentration control unit configured to control, based on measurement results of the oxygen concentration measurement unit, the oxygen concentration of the oxygen-containing gas supplied from the gas supply unit.

8. The oxidation equipment according to claim 1, further comprising:

a collection unit configured to collect a solid content contained in the gas discharged from the gas discharge unit.

9. The oxidation equipment according to claim 1, further comprising:

a support member configured to be placed between the gas supply unit and the fluidized bed to support the fluidized bed and allow the oxygen-containing gas to pass therethrough; and a vibration mechanism configured to vibrate the support member.

10. An oxidation method for oxidizing a raw material containing at least one of carbonized coal and a torrefied biomass using an oxidation equipment having a main body unit forming a fluidized bed, the method comprising:

a gas supply step of supplying an oxygen-containing gas at 150° C. to 300° C. from a lower side to an upper side of the main body unit to form the fluidized bed in which the raw material flows;

an oxidation step of oxidizing the raw material contained in the fluidized bed with the oxygen-containing gas in the main body unit;

a cooling step of cooling an oxidized product obtained by oxidizing the raw material in a cooling unit; and a delivery step of delivering the oxidized product cooled in the cooling step from the cooling unit, wherein the delivery step controls a delivery amount of the oxidized product from the cooling unit based on a differential pressure between a pressure in a freeboard portion above the fluidized bed of the main body unit and a pressure in a portion of the main body unit through which the fluidized bed passes.

11. A method for producing a modified fuel from a raw material containing at least one of carbonized coal and a torrefied biomass using an oxidation equipment having a main body unit forming a fluidized bed, the method comprising:

a gas supply step of supplying an oxygen-containing gas at 150° C. to 300° C. from a lower side to an upper side of the main body unit to form the fluidized bed in which the raw material flows;

an oxidation step of oxidizing the raw material contained in the fluidized bed with the oxygen-containing gas in the main body unit to obtain the modified fuel;

a cooling step of cooling the modified fuel obtained by oxidizing the raw material in a cooling unit; and a delivery step of delivering the modified fuel cooled in the cooling step from the cooling unit, wherein the delivery step controls a delivery amount of the modified fuel from the cooling unit based on a differential pressure between a pressure in a freeboard portion above the fluidized bed of the main body unit and a pressure in a portion of the main body unit through which the fluidized bed passes.

* * * * *